US009067712B2

(12) United States Patent
Stuberg et al.

(10) Patent No.: US 9,067,712 B2
(45) Date of Patent: Jun. 30, 2015

(54) PUSH CATCH

(75) Inventors: Gunnar Stuberg, Werdohl (DE); Juergen Flemming, Luedenscheid (DE); Christiane Schmale, Luedenscheid (DE)

(73) Assignee: Schmale GmbH & Co. KG, Luedenscheid (DE)

( * ) Notice: Subject to any disclaimer, the term of this patent is extended or adjusted under 35 U.S.C. 154(b) by 59 days.

(21) Appl. No.: 13/698,724

(22) PCT Filed: May 14, 2011

(86) PCT No.: PCT/DE2011/001074

§ 371 (c)(1),
(2), (4) Date: Dec. 17, 2012

(87) PCT Pub. No.: WO2011/144202

PCT Pub. Date: Nov. 24, 2011

(65) Prior Publication Data

US 2013/0087565 A1 Apr. 11, 2013

(30) Foreign Application Priority Data

May 20, 2010 (DE) ..... 10 2010 021 112

(51) Int. Cl.

| | |
|---|---|
| ***B65D 45/00*** | (2006.01) |
| ***A45C 13/12*** | (2006.01) |
| ***E05B 1/00*** | (2006.01) |

(Continued)

(52) U.S. Cl.

CPC ..... *B65D 45/00* (2013.01); *A45C 13/123* (2013.01); *E05B 1/0038* (2013.01); *E05B 65/5223* (2013.01); *E05B 2015/0235* (2013.01); *E05C 1/10* (2013.01)

(58) Field of Classification Search

CPC ..... A45C 13/12; B65D 43/22; B65D 45/00; E05B 13/00; E05B 13/002; E05B 65/44; E05B 65/52; E05C 1/04

USPC ..... 220/214, 309.1, 326, 281, 260, 324, 220/315; 292/137, 175, 145, 163, DIG. 11, 292/DIG. 37, DIG. 63, DIG. 38

See application file for complete search history.

(56) References Cited

U.S. PATENT DOCUMENTS

| | | | | |
|---|---|---|---|---|
| 1,434,370 | A | 11/1922 | Crompton et al. | |
| 4,049,313 | A * | 9/1977 | Lundberg | 292/307 R |

(Continued)

FOREIGN PATENT DOCUMENTS

| | | |
|---|---|---|
| DE | 13 77 226 U | 6/1936 |
| DE | 652 754 | 11/1937 |

(Continued)

OTHER PUBLICATIONS

International Search Report of PCT/DE2011/001074, date of mailing Jan. 24, 2012.

*Primary Examiner* — Anthony Stashick
*Assistant Examiner* — Kaushikkumar Desai
(74) *Attorney, Agent, or Firm* — Collard & Roe, P.C.

(57) ABSTRACT

The invention relates to a push catch (2) for containers (1), comprising a push element (21) which is introduced into a housing (22) which is set in a container wall. A shoulder (23) of the housing (22) is supported on the container wall. The push element (21) is under the influence of a spring (24). The housing (22) comprises a radial bore (22') and a bushing (3) is placed in the container wall and protrudes at least in sections into the bore (22').

2 Claims, 1 Drawing Sheet

Figures 1, 2, 3, 4, 5, 6, 7:
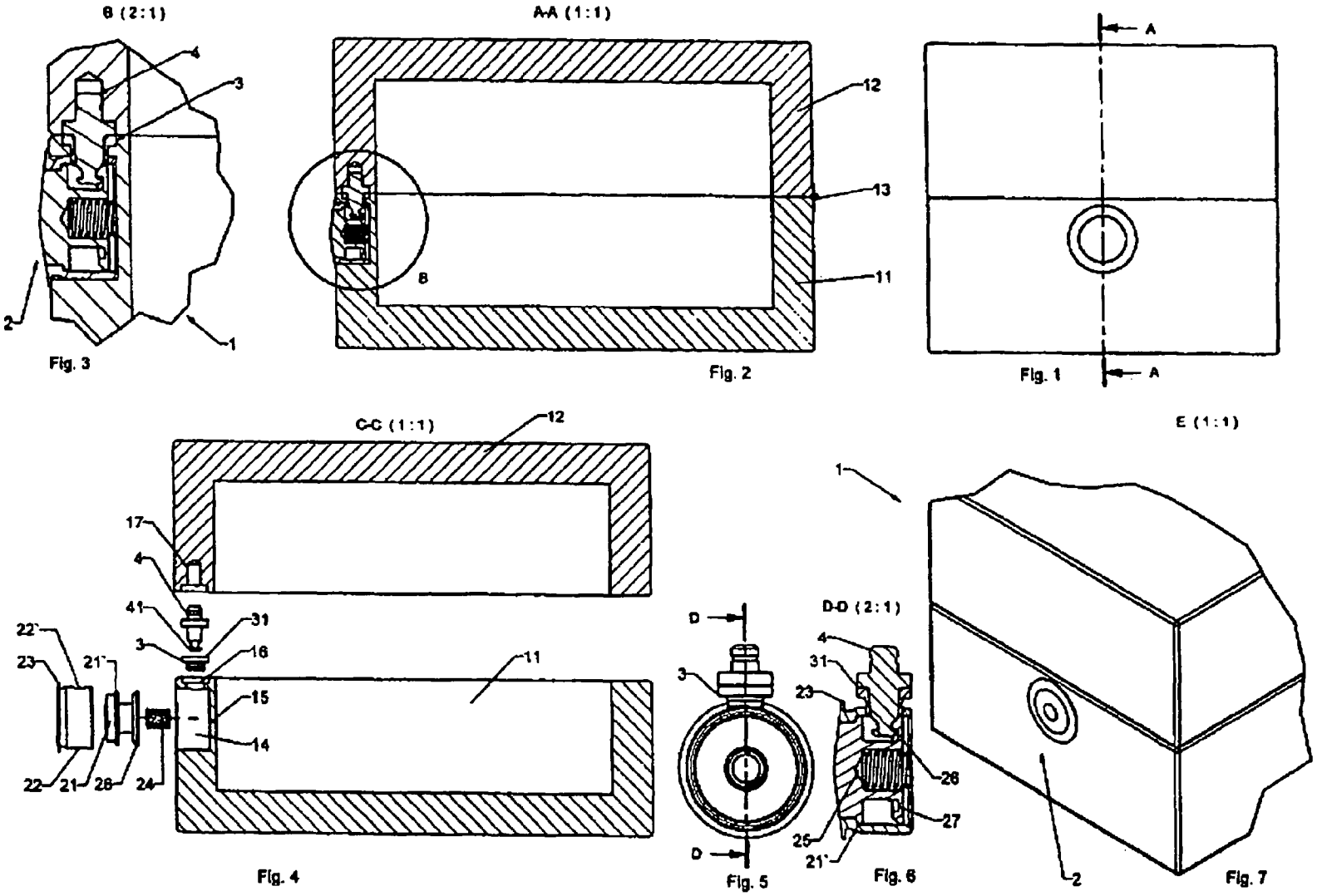

(51) Int. Cl.

| | |
|---|---|
| ***E05B 65/52*** | (2006.01) |
| ***E05C 1/10*** | (2006.01) |
| *E05B 15/02* | (2006.01) |

(56) References Cited

U.S. PATENT DOCUMENTS

| | | | | |
|---|---|---|---|---|
| 4,306,431 | A * | 12/1981 | Craig | 70/79 |
| 4,930,528 | A | 6/1990 | Hatakeyama | |
| 7,695,031 | B2 | 4/2010 | Jackson, Jr. et al. | |
| 2007/0003365 | A1 * | 1/2007 | Walt et al. | 403/362 |
| 2007/0034637 | A1 | 2/2007 | Carmichael | |
| 2011/0011862 | A1 | 1/2011 | Matsumoto et al. | |

FOREIGN PATENT DOCUMENTS

| | | |
|---|---|---|
| DE | 201 14 060 | 11/2001 |
| GB | 606 078 | 8/1948 |
| JP | 2004-209029 A | 7/2004 |

* cited by examiner

PUSH CATCH

CROSS REFERENCE TO RELATED APPLICATIONS

This application is the National Stage of PCT/DE2011/001074 filed on May 14, 2011 which claims priority under 35 U.S.C. §119 of German Application No. 10 2010 021 112.5 filed on May 20, 2010, the disclosure of which is incorporated by reference. The international application under PCT article 21(2) was not published in English.

The invention relates to a push catch for containers, comprising a push element that is guided in a housing that is inserted into a container wall, whereby the housing supports itself on the container wall with a shoulder, and which push element stands under the influence of a spring.

Push catches in themselves are known (cf. for example DE 652 754 C). Such catches are affixed to containers, generally box-shaped containers such as crates, boxes or cases made of wood, plastic, or the like.

A disadvantage of the known push catches consists in that in order to unlock the lid provided under the container, a lever or bracket moves into the interior of the container under the influence of the push element, and thereby releases the lid. This results in the risk that goods accommodated in the container will be damaged. Furthermore, by means of this type of activation, lining the container on the inside with fabric or the like is precluded, because this lining would be destroyed by activation of the lever.

To eliminate this disadvantage, it is known to allow unlocking of the catch by means of a pin provided on the lid of the container, in that the pin plunges into the housing through a bore provided for this purpose, when the lid is closed. It is true that penetration of catch parts into the interior of the container is avoided in this way; however, in order to attach the push element housing, it is necessary that the housing be glued into the bore in the container wall provided for this purpose, in order to avoid unintentional rotation or falling-out of the housing. However, gluing the housing into the container wall has multiple disadvantages, in practice; for example, it cannot be precluded that after the adhesive has been filled in, it will flow out of the bore when the housing is pushed into the bore, and therefore damage the outside of the container, which is often varnished. Furthermore, the housing cannot be removed after the glue has hardened, so that in the event of damage to the catch, the container becomes unusable.

This is where the invention wishes to provide a remedy. The invention is based on the task of creating a push catch for containers, unlocking of which takes place without penetration into the interior of the container, on the one hand, and on the other hand makes gluing the housing into the container wall unnecessary. According to the invention, this task is accomplished in that the housing has a radial bore and that a bushing is provided that is inserted into the container wall and that projects into the bore, at least in certain regions.

With the invention, a push catch for containers is created, in which the housing projects in, in part, from the bore inserted into the container wall at a right angle to the longitudinal center line of the housing. Consequently, the housing is secured to prevent it from falling out and rotating in the container wall. Thus, the housing is held in the container wall purely mechanically, thereby making it possible to do without additional aids, such as adhesive, for example.

In a further development of the invention, the clear width of the bore corresponds to the outside diameter of the bushing. By means of this precise coordination of the two components with one another, a high level of fit precision is brought about, so that the housing is held in the container wall without play. In this way, a qualitatively high level of appeal is brought about during activation of the catch.

Other further developments and embodiments of the invention are indicated in the other dependent claims. An exemplary embodiment of the invention is shown in the drawing and will be described in detail below. The drawing shows:

FIG. 1 a view of a box-shaped container;

FIG. 2 the section along the line A-A in FIG. 1;

FIG. 3 the enlarged representation of the region indicated with "B" in FIG. 2;

FIG. 4 the exploded representation of section shown in FIG. 2;

FIG. 5 the view of the push catch without the container, in an enlarged representation;

FIG. 6 the section along the line D-D in FIG. 5;

FIG. 7 the perspective representation, in certain sections, of the container shown in FIG. 1.

The container 1 selected as an exemplary embodiment has a push catch 2. A bushing 3 is provided, through which a locking bolt 4 passes in the closed state of the container 1.

The container 1 has a lower part 11 that is closed off with a lid 12. The lower part 11 and the lid 12 are connected with one another in articulated manner, by means of a hinge 13.

In the lower part 11 of the container 1, an accommodation 14 is provided on the side facing away from the hinge 13. The accommodation 14 has a bottom 15 that forms the side wall of the lower part 11 of the container 1 in the region of the accommodation 14. A bore 16 is introduced into the side wall of the lower part 11, from the side facing the lid 12, which bore is oriented at a right angle to the center line of the accommodation 14. The bore 16 is configured to be offset. In the lid 12 of the container 1, a dead-end bore 17 is disposed, which is oriented coaxial to the bore 16 in the lower part 11 when the lid 12 is closed.

In the lower part 11 of the container 1, the push catch 2 is provided. The push catch 2 comprises a push element 21 that is guided in a housing 22. The housing 22 has a circumferential shoulder 23 on its end facing away from the bottom 15. The housing 22 is inserted into the accommodation 14 from the side facing away from the bottom 15. It supports itself on the container wall with the shoulder 23. The housing 22 has a radial bore 22' that aligns with the bore 16 in the lower part 11 of the container 1 in the assembled state.

The push element 21 has a ring-shaped projection 21' in its region that faces away from the bottom 15. This region stands under the influence of a spring 24. The spring 24 is guided in a dead-end bore 25 in the push element 21. It supports itself, on the one hand, on the bottom of the dead-end bore 25, on the other hand on the bottom 15 of the accommodation 14. On the side facing the bottom 15, the push element 21 is provided with a plate 26 that surrounds the dead-end bore 25, which plate is provided with an undercut 27 on its outer end.

In the assembled state, a bushing 3 is inserted into the bore 16 in the container wall. The bushing 3 is provided with a passage bore. It is configured to be offset and therefore has a circumferential edge 31 on its end facing away from the push element 21. The bushing 3 projects into the bore 22' of the housing 22 in certain regions, as can particularly be seen in FIGS. 3 and 6.

A locking bolt 4 is inserted into the offset dead-end bore 17 in the lid 12. The locking bolt 4 has a plate 41 on its end facing the lower part 11. In the closed state of the container 1, the locking bolt 4 plunges into the bushing 3 in certain regions, and extends all the way into the region of the push element 21 with its plate 41.

In the locked state of the container 1 (FIGS. 3 and 6), the undercut 27 engages behind the plate 41. In this connection, the push element 21 stands under the influence of the spring 24. Because of the spring force, the push element 21 supports itself on the housing 22 with its ring-shaped projection 21'. In this state, the undercut 27 engages behind the plate 41, so that opening of the lid 12 is not possible. To unlock the push catch 2, the push element 21 is pressed counter to the force of the spring 24, in the direction of the bottom 15, until the push element 21 makes contact with the bottom 15. In this position, the plate 41 of the locking bolt 4 is released by the undercut 27, so that opening of the lid 12 is made possible. When the push element 21 is let go, it moves back into its starting position under the influence of the spring 24.

During closing of the container 1, the locking bolt 4 plunges into the bushing 3 until the plate 41 of the locking bolt 4 comes into contact with the outside of the undercut 27. By means of the beveled configuration of both the undercut 27 and the plate 41, further closing movement of the lid 12 leads to an evasion movement of the push element 21 in the direction of the bottom 15, so that the plate 41 can pass by the undercut 27. After the plate 41 has gone past, the push element 21 moves back into its starting position under the influence of the force 24. In this state, the undercut 27 engages behind the plate 41 again, thereby locking the container 1.

According to the invention, the bushing 3 is inserted into the bore 16. Because the bushing 3 engages into the bore 22' in the housing 22 in certain regions, as can particularly be seen in FIG. 6, the housing 22 is secured to prevent it from falling out or being pressed out of the accommodation 14. Rotation of the housing 22 in the accommodation 14 is also prevented in this manner. Because the clear width of the bore 22' of the housing 22 corresponds to the outside diameter of the bushing 3 in the region facing the accommodation 14, fit-precise locking of the housing 22 in the accommodation 14 is created. In this way, not only is operation of the catch possible, in problem-free manner, but also a high level of technical appeal is brought about, because no movement of the housing in the lower part of the container takes place even when the push catch is activated. The configuration of the push catch 2 according to the invention therefore testifies to a high level of technical quality.

The invention claimed is:

1. A container with a push catch, the container having a lower part and a lid, the push catch comprising a push element that is guided in a housing that is inserted into a wall of the container, wherein the housing supports itself on the wall of the container with a shoulder, wherein the push element stands under the influence of a spring, the spring being guided in a dead-end bore in the push element, being supported on a bottom of the dead-end bore, being supported on a bottom of an accommodation in the lower part of the container, and forcing the push element in a direction away from the bottom of the accommodation, wherein on a side facing the lid of the container the housing has a radial bore at a right angle to a center line of the accommodation, wherein a bushing is provided that is inserted into the wall of the container and that projects into a bore of the wall of the container, the bore of the wall of the container being introduced in the wall of the container from a side facing the lid, wherein the bushing projects into the radial bore of the housing, at least in certain regions so that the housing is secured in the container wall mechanically without using adhesive, wherein a locking bolt is provided, the locking bolt partially entering the bushing when the container is closed and the locking bolt having an end facing the lower part of the container and having a locking bolt plate at the end, wherein the push element is provided with a push element plate surrounding the dead-end bore, the push element plate having an outer end and an undercut at the outer end, and wherein when the container is locked the undercut of the push element plate engages behind the locking bolt plate.

2. The container with the push catch according to claim 1, wherein the clear width of the radial bore corresponds to the outside diameter of the bushing.

* * * * *